US005647532A

United States Patent [19]

de Villiers et al.

[11] Patent Number: 5,647,532

[45] Date of Patent: Jul. 15, 1997

[54] AIR DIFFUSER

[75] Inventors: Kobus de Villiers; Noel de Villiers, both of Cape Town, South Africa

[73] Assignee: Brian Rickard (Pty) Ltd., Cape Town, South Africa

[21] Appl. No.: 661,025

[22] Filed: Jun. 10, 1996

[30] Foreign Application Priority Data

Jun. 8, 1995 [ZA] South Africa ..... 95/4746
Aug. 18, 1995 [ZA] South Africa ..... 95/6919

[51] Int. Cl.[6] ..... F24F 7/00

[52] U.S. Cl. ..... 236/495; 454/253

[58] Field of Search ..... 236/49.5, 99 E, 236/101 B, 91 E; 454/258

[56] References Cited

U.S. PATENT DOCUMENTS

| | | | |
|---|---|---|---|
| Re. 30,953 | 6/1982 | Vance et al. | 236/49.5 |
| 4,491,270 | 1/1985 | Brand | 236/49.5 |
| 4,509,678 | 4/1985 | Noll | 236/49.5 |
| 4,523,713 | 6/1985 | Kline et al. | 236/1 C |
| 4,821,955 | 4/1989 | Kline et al. | 236/49.5 |

*Primary Examiner*—William E. Tapolcai
*Attorney, Agent, or Firm*—Cushman Darby & Cushman IP Group Pillsbury Madison & Sutro LLP

[57] ABSTRACT

An air conditioning diffuser is disclosed which includes two temperature sensitive elements. A first element detects room temperature and a second element ducting temperature. When room temperature increases during supply of cooled air, the first element moves a control unit upwards and this results in a first disc of the control unit moving away from a surface on a pivotally mounted link. The link pivots about its mounting so that a baffle hanger and a baffle move down allowing more cooled air to flow through the diffuser. When heated air is being supplied, the second element displaces the unit in the upward direction so that baffle control is transferred from the first disc and the first link surface to a second disc and a second link surface. The link surfaces lie one radially inwardly and one radially outwardly of the link mountings. When room temperature rises, the first element moves the control unit up and the second disc bears on the second link surface lifting the baffle and limiting supply of heated air.

8 Claims, 2 Drawing Sheets

AIR DIFFUSER

FIELD OF THE INVENTION

THIS INVENTION relates to diffusers.

BACKGROUND TO THE INVENTION

The term "diffuser" is used to designate those devices which, in air conditioning systems, are employed for the purpose of regulating flow of air, which may be heated air or cooled air, from air conditioning ducting into a room.

Various conditions occur in an air conditioned room depending on whether the outside temperature is above that at which the room is to be maintained or below that at which the room is to be maintained.

In "Summer" conditions cooled air is fed from the air conditioning plant to the diffuser. If the room temperature is below that at which it is desired to maintain it, because cooled air has previously been fed in, then the diffuser must remain closed to prevent further cooled air entering the room.

As the room heats up a room temperature sensing element must detect this and open the diffuser to allow more cooled air into the room. The diffuser thus opens and closes as the room temperature varies.

In "Winter" conditions heated air is fed to the diffuser. If the room is above the requisite temperature, because heated air has previously been fed into the room, the diffuser must remain closed to prevent further heated air entering. As the room cools down, the room temperature sensing element must detect this and open the diffuser to allow more heated air in. The diffuser consequently opens and closes as the room temperature varies.

The present invention seeks to provide a construction which enables a single room temperature sensing element to be able to close a diffuser when the room is too cold (in Summer conditions) and close the diffuser when the room is too hot (in Winter conditions). This avoids the use of complex constructions involving two or more room temperature sensing elements.

BRIEF DESCRIPTION OF THE INVENTION

According to the present invention there is provided a diffuser for controlling flow of air in an air conditioning system, the diffuser including an air flow control baffle, a first temperature sensitive element for sensing room temperature and having a part which moves in response to changes in room temperature, first and second operating members connected to said part for movement therewith in response to changes in room temperature, said members serving to move said baffle in opening and closing movements when they are themselves displaced by said part of said element, and a second temperature sensitive element for sensing the temperature in ducting through which heated and cooled air flows and having a part which moves in response to ducting temperature variations, movements of said part of said second element displacing said members between a first position in which one of them is effective to move the baffle in said opening and closing movements when cooled air is supplied to the ducting and a second position in which the other of said members is effective to move said baffle in said opening and closing movements when heated air is supplied to the ducting.

The diffuser can include a framework on which said second temperature sensitive element is mounted, said framework being secured to and moving with said part of said first temperature sensitive element.

In the preferred form the diffuser includes a link one end portion of which is pivotally mounted and the other end portion of which is connected to the baffle, said one end portion of the link including a first surface which is on the side of its pivotal mounting remote from its connection to the baffle and a second surface which is on the same side of its pivotal mounting as its connection to the baffle, said members being spaced apart with said link surfaces between them, said first surface being positioned to contact said first member and said second surface being positioned to contact said second member, forces exerted by said first and second members on said first and second surfaces pivoting the link in the direction which moves the baffle towards its closed position.

In this form there can be a unit having first and second spaced discs which are secured together so that they move rectilinearly along an axis, said first and second discs constituting said first and second members, said one end portion of said link being between said first and second discs whereby said first and second surfaces contact said first and second discs respectively, said link extending radially with respect to said axis, said first and second surfaces being one radially inwardly of the pivotal mounting of the link and the other radially outwardly of the pivotal mounting of the link.

Said unit can further include a third disc which moves in unison with said first and second discs, there being a lever pivotally mounted between its ends, said part of said second element displacing a first end of said lever in response to temperature variations in the ducting and a second end of said lever being between said second and third discs and serving to displace said unit and hence said first and second discs with respect to said one end portion of the link thereby selectively to bring said first disc and said first surface, or said second disc and said second surface, into co-operation with one another.

To provide a diffuser which is adapted to be mounted on a ceiling said part of said first temperature sensitive element is connected to and is co-axial with a rod which in use is vertical and co-incident with said axis, said first disc being above the second disc and the third disc being below the second disc and said unit being moved upwardly with increasing room temperature and downwardly with decreasing room temperature, said second temperature sensitive element being orientated so that said first end of said lever is pushed down when heated air is flowing in the ducting whereby the second end of the lever lifts said unit upwardly with respect to said one end portion of said link.

Preferably a hanger connects said other end portion of the link to said baffle, and vertical columns are provided which form guides for said baffle.

To ensure that the baffle is displaced without any risk of it skewing, two of said links can be provided, the links extending in diametrically opposed directions from said axis.

BRIEF DESCRIPTION OF THE DRAWINGS

For a better understanding of the present invention, and to show how the same may be carried into effect, reference will now be made, by way of example, to the accompanying drawings in which.

DETAILED DESCRIPTION OF THE DRAWINGS

Figure 1:
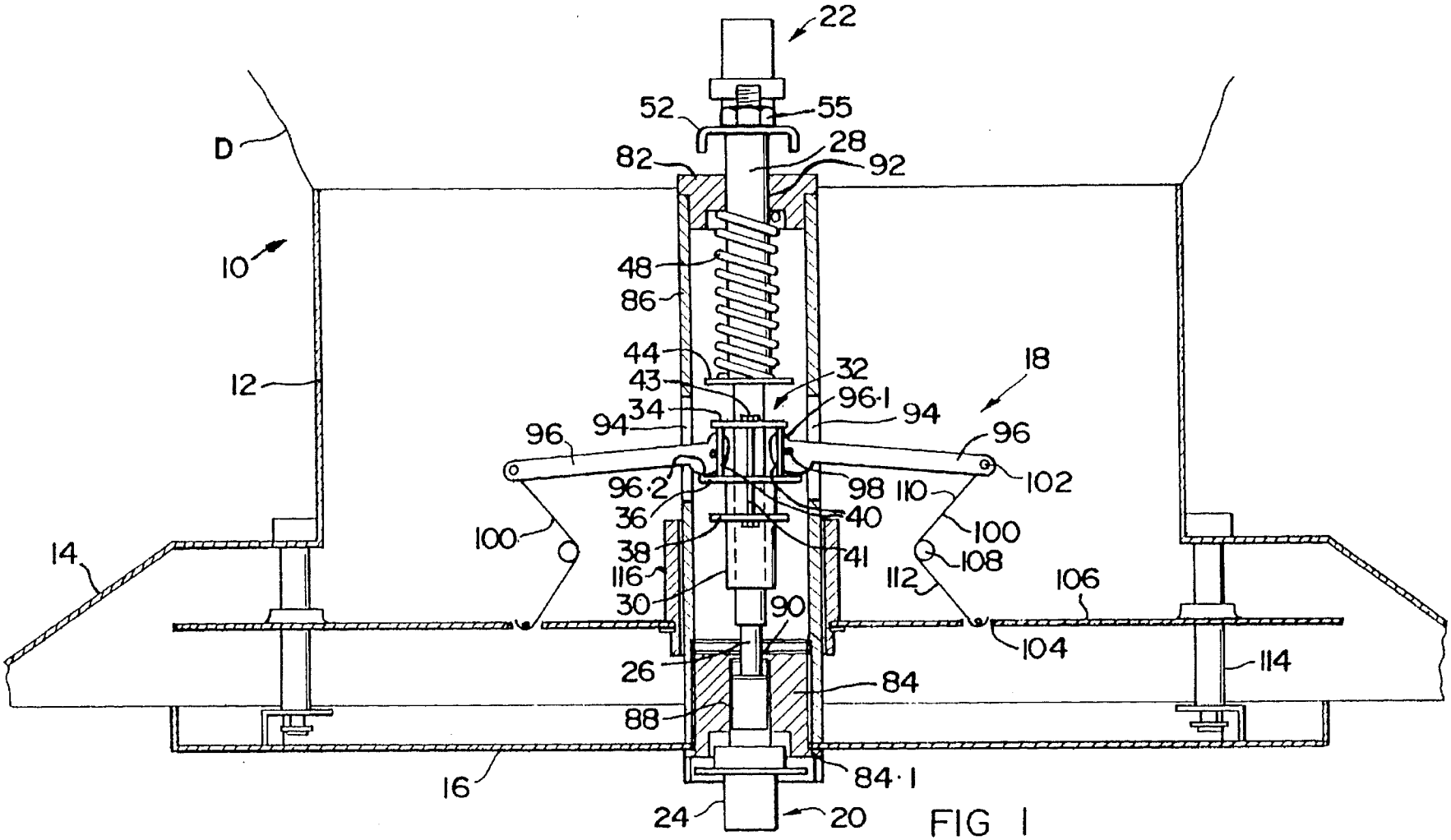
FIG. 1 is a vertical section through a diffuser.

The diffuser 10 illustrated comprises a short vertical duct 12 which is connected at its upper end to the ducting D through which cooled air or heated air flows to the diffuser depending on the cooling or heating requirements which prevail. At the lower end of the duct 12 there is a truncated cone 14 which is mounted with its smaller end uppermost. At the wider lower end of the cone there is a trim disc 16 which conceals the operating mechanism, generally designated 18, of the diffuser. The trim disc 16 is constituted by a sheet of metal with an upturned rim. The lower end of the cone 14 is square or rectangular in shape and is bounded by a horizontal rim. This rim rests on the hangers (not shown) that are used to support the false ceiling in a building.

The operating mechanism 18 comprises two thermally sensitive elements 20, 22 which in the art are often referred to as "pills". Each element 20, 22 comprises a housing 24 in which there is a wax that melts at a predetermined temperature and thereafter expands. One end of the housing 24 is closed and the other end of the housing has an opening therein. A rod 28 emerges from the housing 24 of the element 20 through this opening and a rod 56 emerges through the opening of the element 22. On the part of each rod 28, 56 within the respective housing there is a piston. When the wax expands it pushes the pistons in the direction which causes more of the rods 28, 56 to protrude from the housing 24. Springs (which will be described hereinafter) are provided in association with the elements 20, 22 for pushing the rods in the opposite direction, that is, back into the housings 24 when the wax contracts on cooling.

The rod 28 passes freely through a bush 30 forming part of a control unit 32. The control unit 32 further includes three discs 34, 36 and 38. The discs 34 and 36 are held a fixed distance apart by two columns 40 opposite ends of which are attached to the discs 34 and 36. Pins 41 pass through holes in all three discs, the ends of the pins 41 being tapped and there being nuts 43 on the ends of the pins 41. The pins 41 and nuts 43 pull the discs 34 and 38 towards one another.

The bush 30 passes through a central hole in the disc 38 and is stepped so that it has a larger diameter upper part and smaller diameter lower part. The smaller diameter part extends from below the disc 38 through the hole in the disc 38. The disc 38 is below the step between the smaller and larger diameter parts and presses on the step when the disc 38 is pulled towards the disc 36 as the nuts 43 are tightened.

The upper end of the bush 32 is turned down to form a spigot which fits in the hole in the disc 36. The step between the spigot and the larger diameter part of the bush 32 bears on the underside of the disc 36. Thus the columns 40 and bush 30 form spacers which hold the discs 34, 36 and 38 apart when the nuts 43 are tightened.

The rod 28 has a collar 44 secured thereto above the disc 34. A spring 48 bears on the collar 44.

The element 22 is mounted parallel to the element 20. The housing 24 of the element 22 is secured to a rigid framework 50 which includes an arm 52 and a column 54, the arm 52 projecting from the upper end of the column 54 of the framework 50.

The arm 52 has a hole in the end thereof remote from the column 54 and the turned down and threaded upper end of the rod 28 passes through this hole. A nut 55 secures the arm 52 to the rod 28 so that the framework 50 and element 22 move rectilinearly with the rod 28.

The lower end of the rod 56 is guided in an opening 58 in a horizontal partition 60 forming part of the framework 50. A spring 62 acting between a nut 64 screwed onto a threaded end portion of the rod 56 and the fixed partition 60 serves as the return spring for the rod 56.

Near the lower end of the rod 56 there are two vertically spaced discs 66, 68. The rod 56 is turned down and threaded at its lower end to form a downwardly facing shoulder. The disc 66 is below said shoulder and the two discs are held apart by a sleeve 70. A nut 72 screwed onto the rod 56 bears on the lower disc 68 pressing the disc 68 against one end of the sleeve 70, the other end of the sleeve 70 against the disc 66 and the disc 66 against the shoulder on the rod 56.

Two parallel, spaced levers 74 are pivotally mounted by means of pins 76 on the framework 50. Each of the levers 74 has circular end portions 78.1 and 78.2. The rods 28 and 56 pass between the end portions 78.1 and 78.2 respectively of the levers 74. The portions 78.2 of the levers 74 fit snugly between the discs 66 and 68 and the end portions 78.1 fit snugly between the discs 36 and 38 of the unit 32. The fits are such that the levers 74 are free to pivot up and down about the pins 76 with respect to the pairs of discs 66, 68 and 34, 36. The lengths and positions of the levers 74 are such that a line, perpendicular to the plane of each lever, which passes through the centre points of the circular portions 78.2, intersects the longitudinal axis of the rod 56. Similarly, a line, perpendicular to the plane of each lever, which passes through the centre points of the portions 78.1, intersects the longitudinal axis of the rod 28.

Top and bottom caps 82 and 84 are mounted at opposite ends of a tube 86 which extends from the disc 16 to just below the level of the top of the duct 12. The rod 28 is co-axial with the tube 86. The bottom cap 84 screws into the lower end of the tube 86 and the element 20 screws into the cap 84 from below. A shoulder 84.1 just below the threading of the cap 84 forms a seat for the trim disc 16. It will be noted that the housing 24 is externally threaded and that the cap 84 has an internally threaded socket 88 into which the housing 24 is screwed. It also has a hole 90 through which the rod 28 passes. The top cap 82 is a force fit in the upper end of the tube 86 and has a guide hole 92 in it through which the upper part of the rod 28 passes freely. The cap 82 forms the second seat for the spring 48.

The tube 86 has an opening 80 (FIG. 2) in the wall thereof through which the levers 74 pass. The tube 86 also has two diametrically opposed openings 94 (FIG. 1) therein, the openings 94 both being displaced by 90 degrees with respect to the opening 80. Two operating links 96 pass through the openings 94. The links 96 are pivotally mounted on the tube 86. The pivots consist of pins 98 spanning across the interior of the tube 86.

Figure 2:
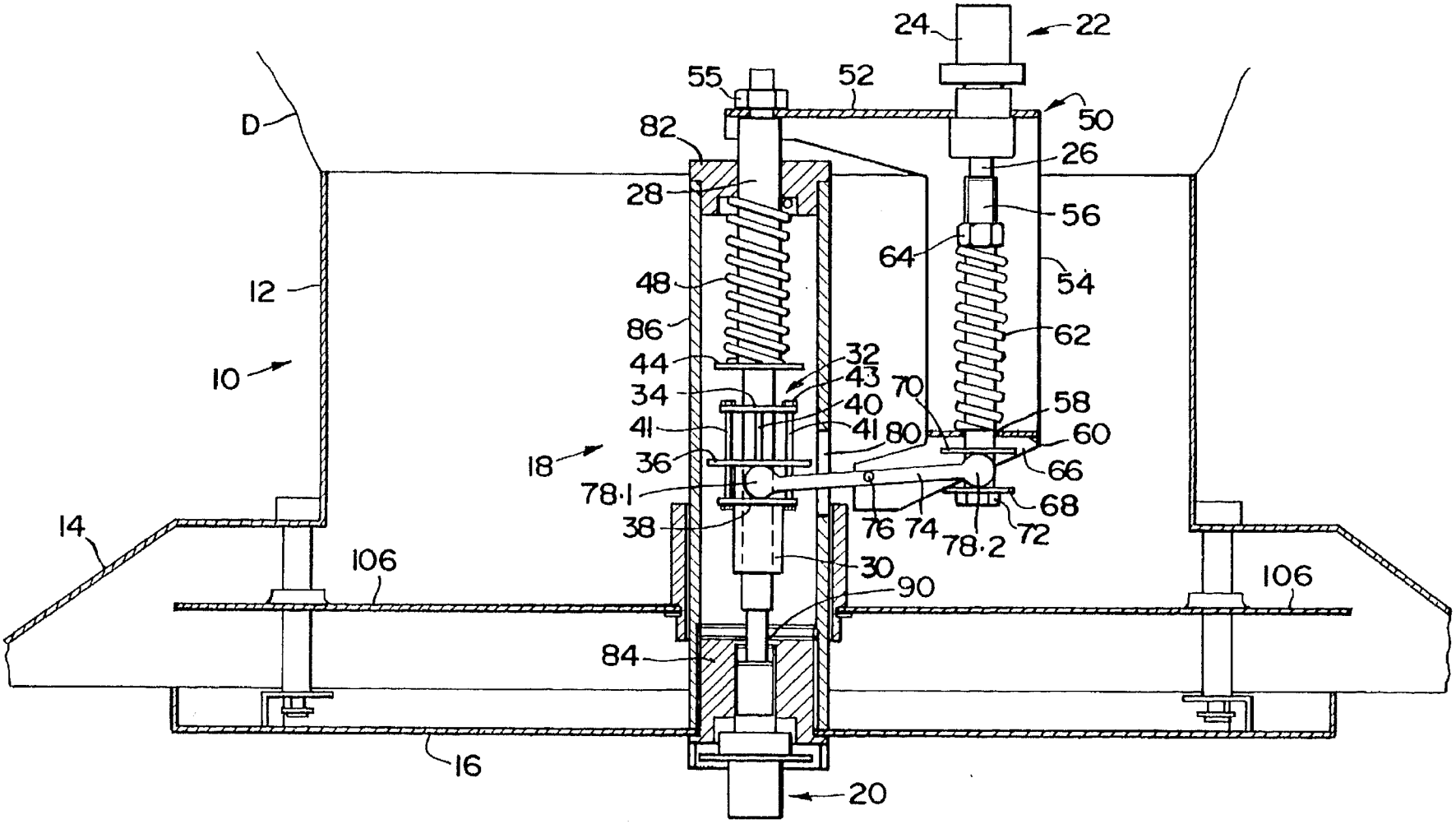
FIG. 2 is a further vertical section through the diffuser of FIG. 1 and taken at right angles to the section of FIG. 1.

Hangers 100 are pivotally mounted at 102 on the levers 96 and pass through holes 104 in an airflow control baffle 106. Each hanger 100 is in the form of a spring which is fabricated using resiliently flexible wire. As seen in FIG. 1, each hanger 100 has a central coil 108 and two arms 110 and 112. The hangers 100 pull the links 96 and baffle 106 towards one another.

The baffle 106 is disc-like and its periphery is close to the inner face of the cone 14 when the diffuser is closed. The lower ends of the arms 112 of the hanger 100 are bent over to form hooks which lie below the baffle 106. The baffle 106 rests on the hooks and is supported thereby.

Each link 96 has two cam surfaces. The first cam surface 96.1 of each link 96 co-operates with the underside of the disc 34. The second cam surface 96.2 of each link 96 co-operates with the top surface of the disc 36. The surfaces 96.1 are radially inwardly of the pivot pins 98 and the surfaces 96.2 are radially outwardly of the pins 98. The spacing between the surfaces 96.1 and 96.2 is less than the spacing between the discs 34 and 36.

A number of guide columns 114 are mounted on, and depend from, the cone 14. The lower ends of these columns are connected to the trim disc 16 so that the trim disc is supported by these columns. The columns 114 pass through holes in the baffle 106 and form guides therefor.

A sleeve 116 is fixed to the baffle 106 and is co-axial with the tube 86. The sleeve 116 moves with the baffle 106 and forms a central guide therefor.

The element 20 senses room temperature and the element 22 detects duct temperature. On the assumption that cooled air is flowing in the ducting D, the rod 56 is fully retracted. The levers 74 are thus in the position illustrated in FIG. 2, the right hand ends having been lifted by the lower disc 68. If it is further assumed that the room is cold, then the rod 28 is in its lowermost position to which it was urged by the spring 48 when the wax in the element 20 contracted. The top disc 34 thus presses down, under the influence of the spring 48, on the surfaces 96.1 at the inner ends of the links 96. This pivots the outer ends of the links 96 upwardly. The hangers 100 are thus lifted and the baffle 106 is close to the cone 14. Little or no cooled air thus flows through the diffuser.

As the room heats up, the rod 28 is pushed upwardly. The rod slides through the bush 30 and lifts the framework 50 by raising the arm 52. The framework 50 lifts the levers 74 and these in turn lift the unit 32. There is consequently no relative movement between the unit 32 and the levers 74. The inner ends of the links 96 tilt upwardly as they are no longer held down by the disc 34 bearing on the surfaces 96.1. Tilting is caused by the mass of the baffle 106, hangers 100 and the outer parts of the links 96. As the baffle 106, hangers 100 and outer parts of the links 96 move down, the gap between the cone 14 and the baffle 106 increases and cooled air flows into the room. As the room cools down the wax in the element 20 contracts and the spring 48 pushes the rod 28 and hence the control unit 32 down. The disc 34 pushes on the surfaces 96.1 of the inner ends of the links 96 tilting the inner ends downwardly and the outer ends upwardly. The result is that the baffle 106 moves up towards the cone 14 closing-off the annular gap and reducing the amount of air flow.

As explained, the framework 50, element 22, rod 56, discs 66, 68 and levers 74 all move up and down with the rod 28. There is thus no relative movement between the discs 36, 38 and the levers 74 as the temperature of the element 20 varies. Consequently, the unit 32 does not move with respect to the rod 28.

In cool or cold atmospheric conditions, heated air flows in the ducting D and the wax in the thermally sensitive element 22 expands pushing the rod 56 down against the action of the spring 62. The end portions 78.2 of the levers 74 between the discs 66, 68 are thus moved down and the end portions 78.1 between the discs 36, 38 move up lifting the control unit 32. As the disc 34 moves up, the inner ends of the links 96 are not now restrained, the mass of the baffle 106, hangers 100 and outer parts of the links 96 causes the links to pivot about the pins 98. The hangers 100 are lowered and the baffle 106 descends to the fully open position of the diffuser. In this position the maximum amount of heated air can flow into the room so as to raise its temperature. This is the condition that prevails when the heating system is switched on in the morning.

As the room heats up, the wax in the thermally sensitive element 20 expands and pushes the rod 28, the framework 50, the levers 74 and hence the control unit 32 upwardly. The disc 36 acts on the surfaces 96.2 of the links 96 and pivots them in the direction which lifts the hangers 100 and the baffle 106 thereby closing-off heated air flow. As the room cools the rod 28, framework 50, levers 96 and operating unit 32 move down under the influence of the spring 48 as the wax contracts and this allows more heated air to flow into the room.

We claim:

1. A diffuser for controlling flow of air in an air conditioning system, the diffuser including an air flow control baffle, a first temperature sensitive element for sensing room temperature and having a part which moves in response to changes in room temperature, first and second operating members connected to said part for movement therewith in response to changes in room temperature, said members serving to move said baffle in opening and closing movements when they are themselves displaced by said part of said element, and a second temperature sensitive element for sensing the temperature in ducting through which heated and cooled air flows and having a part which moves in response to ducting temperature variations, movements of said part of said second element displacing said members between a first position in which one of them is effective to move the baffle in said opening and closing movements when cooled air is supplied to the ducting and a second position in which the other of said members is effective to move said baffle in said opening and closing movements when heated air is supplied to the ducting.

2. A diffuser as claimed in claim 1 and including a framework on which said second temperature sensitive element is mounted, said framework being secured to and moving with said part of said first temperature sensitive element.

3. A diffuser as claimed in claim 1, and including a link one end portion of which is pivotally mounted and the other end portion of which is connected to the baffle, said one end portion of the link including a first surface which is on the side of its pivotal mounting remote from its connection to the baffle and a second surface which is on the same side of its pivotal mounting as its connection to the baffle, said members being spaced apart with said link surfaces between them, said first surface being positioned to contact said first member and said second surface being positioned to contact said second member, forces exerted by said first and second members on said first and second surfaces pivoting the link in the direction which moves the baffle towards its closed position.

4. A diffuser as claimed in claim 3, and including a unit having first and second spaced discs which are secured together so that they move rectilinearly along an axis, said first and second discs constituting said first and second members, said one end portion of said link being between said first and second discs whereby said first and second surfaces contact said first and second discs respectively, said link extending radially with respect to said axis, said first and second surfaces being one radially inwardly of the pivotal mounting of the link and the other radially outwardly of the pivotal mounting of the link.

5. A diffuser as claimed in claim 4 wherein said unit includes a third disc which moves in unison with said first and second discs, there being a lever pivotally mounted between its ends, said part of said second element displacing a first end of said lever in response to temperature variations in the ducting and a second end of said lever being between said second and third discs and serving to displace said unit and hence said first and second discs with respect to said one end portion of the link thereby selectively to bring said first disc and said first surface, or said second disc and said second surface, into cooperation with one another.

6. A diffuser as claimed in claims 5, wherein said part of said first temperature sensitive element is connected to and is co-axial with a rod which in use is vertical and co-incident with said axis, said first disc being above the second disc and the third disc being below the second disc and said unit being moved upwardly with increasing room temperature and downwardly with decreasing room temperature, said second temperature sensitive element being orientated so that said first end of said lever is pushed down when heated air is flowing in the ducting whereby the second end of the lever lifts said unit upwardly with respect to said one end portion of said link.

7. A diffuser as claimed in claim 3, wherein a hanger connects said other end portion of the link to said baffle, and vertical columns are provided which form guides for said baffle.

8. A diffuser as claimed in claim 3, and including two of said links, the links extending in diametrically opposed directions from said axis.

* * * * *